United States Patent [19]

Patterson

[11] Patent Number: 4,619,538

[45] Date of Patent: Oct. 28, 1986

[54] ADJUSTABLE LOAD, FRICTION FEED, QUICK TEAR BAR MECHANISM

[75] Inventor: Richard G. Patterson, Bellevue, Wash.

[73] Assignee: Mannesmann Tally Corporation, Kent, Wash.

[21] Appl. No.: 697,955

[22] Filed: Feb. 4, 1985

[51] Int. Cl.[4] ..... B41J 11/66; B41J 11/32; B26D 7/06

[52] U.S. Cl. ..... 400/621; 400/593; 400/616.3; 83/423; 83/424

[58] Field of Search ..... 400/616.3, 621, 621.2, 400/593, 616; 83/423, 424

[56] References Cited

U.S. PATENT DOCUMENTS

| | | | |
|---|---|---|---|
| 1,425,907 | 8/1922 | Sherman . | |
| 1,586,343 | 5/1926 | Waldheim | 400/621 X |
| 1,586,715 | 6/1926 | Smith . | |
| 1,684,155 | 9/1928 | Smith | 400/621 X |
| 1,964,371 | 6/1934 | Thomas | 400/621 X |
| 2,241,357 | 5/1941 | Paschke | 400/621 |
| 2,399,369 | 4/1946 | McFarland | 197/133 |
| 2,555,728 | 6/1951 | Bradt | 197/133 |
| 2,807,346 | 9/1957 | Davidson et al. | 197/133 |
| 2,808,919 | 10/1957 | Frobel | 400/621 |
| 3,212,617 | 10/1965 | Sugiyama | 197/133 |
| 3,824,870 | 7/1974 | Yablonski et al. | 74/243 |
| 4,244,288 | 1/1981 | Harasina | 101/93.02 |
| 4,275,629 | 6/1981 | McDowell | 83/423 X |
| 4,483,635 | 11/1984 | Wisner et al. | 400/621 X |
| 4,524,658 | 6/1985 | Focke et al. | 83/422 X |
| 4,568,211 | 4/1986 | Fox et al. | 400/621 |

FOREIGN PATENT DOCUMENTS

| | | | |
|---|---|---|---|
| 325476 | 5/1919 | Fed. Rep. of Germany | 400/621 |
| 126469 | 9/1980 | Japan | 400/621 |
| 907449 | 10/1962 | United Kingdom | 400/621 |

OTHER PUBLICATIONS

IBM Tech. Disc. Bulletin, "Customer-Installable Forms Separator Bar", vol. 27, No. 1B, Jun. 1984, pp. 535-536.

*Primary Examiner*—Edgar S. Burr
*Assistant Examiner*—James R. McDaniel
*Attorney, Agent, or Firm*—Christensen, O'Connor, Johnson & Kindness

[57] ABSTRACT

An adjustable load tear bar mechanism for a friction feed platen (15) that comprises a tear bar assembly (31) and spring loading mechanisms (33) is disclosed. The tear bar assembly (31) comprises a tear bar (51) mounted between a pair of side arms (41, 43) located on opposite ends of the platen (15). The tear bar (51) is an inverted, generally U-shaped channel. Positioned in the channel is a roller shaft (45) on which a plurality of friction feed rollers (47) are mounted. The downstream ends of the side arms (which overlie the platen) are pivotally attached to walls (11, 13) of the printer chassis. The tear bar (51) and roller shaft (45) extend between the upstream ends of the side arms (41, 43). Mounted on the roller shaft (45) so as to be rotatable therewith are arm hooks (53, 55). One of the arm hooks is part of a detent mechanism that includes teeth (125) that co-act with a spring (59) and plunger (57) housed in one of the side arms (43). The position of the teeth (125) and, thus, the rotational position of the roller shaft (45) is controlled by a detent lever (121). The arm hooks (53, 55) are attached by the spring loading mechanisms (33) to the printer chassis. More specifically, the hook arms are attached by hooks (165) to springs (163) mounted in housings (161) connected to the printer chassis upstream of the tear bar (51). The position of the arm hooks (53, 55), which control the pressure applied by the tear bar (51) and friction rollers (47) to the platen (15), is controlled by the latched position of the detent mechanism.

8 Claims, 5 Drawing Figures

ADJUSTABLE LOAD, FRICTION FEED, QUICK TEAR BAR MECHANISM

TECHNICAL AREA

This invention relates to tear bar mechanisms and, more particularly, tear bar mechanisms for printers.

BACKGROUND OF THE INVENTION

Presently printers, particularly computer controlled printers, are extensively used to create various types of documents. In some instances printers create the entire document. In other instances, printers merely fill in variable text on preprinted forms that include lines and fixed (e.g., nonvariable) text. For example, airline tickets are preprinted forms on which the traveler's name and flight data is printed. In order to avoid the need to insert blank sheets of paper or preprinted forms each time a document is to be created, paper and many forms are produced in continuous sheets. Each element of the sheets—separate form or piece of blank paper—is separated from the adjacent elements by perforations that allow printed documents to be separated from the continuous sheet by "tearing" the printed document from the continuous sheet after the printed document exits from the printer. Usually the sheets are fan folded at the perforations.

In many printers, continous sheets are moved through the printer by tractors. Tractors include drive belts or wheels with pins that engage holes located in tear strips positioned along the edge of the continuous sheets. Tractor feeds have a number of advantages. First, they prevent skewing of the continuous sheets as they are moved through the printer. Further, they maintain the alignment of multiple layer continuous sheets if edge holes are formed in all of the layers.

The tractors of most printers are located downstream of the print mechanism, i.e., downstream of the printer platen. These tractors pull the continuous sheets through the printer. In order to avoid having to continuously retread the tractors, printed documents are moved to a point downstream of the tractors before they are removed by tearing along the separating perforations. This usually results in the creation of an unprinted region between documents since the tractors are usually located several inches downstream of the platen. While such a loss is acceptable when long documents are printed on inexpensive blank paper or when preprinted information is positioned near the top of a document or when a large blank heading area near the top of a document is needed or desired, it is unacceptable when short documents on preprinted forms are printed, particularly when the forms are expensive multiple copy forms. This problem has been avoided by placing tractors upstream of the print mechanism and using them to push continuous sheets into the printer, which is friction fed by the platen and rollers past the print head. The use of upstream tractors avoids the skewing problem that occurs with printers that rely solely on friction feed platen/roller mechanisms. In order to avoid paper buckling between upstream tractors and the printer platen, the printer platens of printers with upstream tractors are sized and/or driven such that the platen peripheral speed is slightly greater than the tractor push speed.

While the use of upstream tractors allows printed documents to be separated from a continuous sheet at a location slightly beyond the print head, acceptable separation frequently requires the application of a holding force to the "next" element of a continuous sheet as the printed document is being separated. That is, a tear bar mechanism is needed to press the next element of a continuous sheet against the printer platen when a printed document is being separated. For various reasons, prior tear bar mechanisms have not proven to be entirely satisfactory. In some instances, they have been located an undesirable distance downstream of the print head. In some instances, the tear bar has worked satisfactorily with one weight of continous paper but not with other weights. Multiple copy or multiple layer continuous sheets have also created problems. The present invention is directed to providing a tear bar mechanism that avoids these and other problems.

SUMMARY OF THE INVENTION

In accordance with this invention, an adjustable load tear bar mechanism for a friction feed platen is provided. The tear bar mechanism comprises a tear bar supported by spring loaded arms that overlie the platen. The downstream ends of the arms are pivotally attached to the chassis of the printer and the tear bar is located near the upstream ends of the arms and positioned adjacent to the platen. The tear bar is an inverted, generally U-shaped channel. Positioned in the channel is a roller shaft on which a plurality of feed rollers are mounted. The upstream ends of the arms are connected to the printer chassis by an adjustable spring loaded mechanism. Thus, the impingement force applied to the platen by the tear bar and the feed rollers is adjustable.

In accordance with further aspects of this invention, the adjustable spring loaded mechanism includes arm hooks (preferably two) mounted on the roller shaft and a detent mechanism for latching the roller shaft in predetermined positions thereby locking the arm hooks in predetermined positions.

In accordance with other aspects of the invention, the adjustable spring loaded mechanism also includes coil spring assemblies (preferably two) attached to the arm hooks. Preferably the coil spring assemblies include spring boxes in which coil springs are mounted and hooks for attaching the coil springs to the arm hooks such that the coils springs apply pressure to the roller shaft and, thus, the feed rollers and the tear bar.

In accordance with still other aspects of this invention, preferably, the detent position adjustment mechanism comprises a spring and plunger assembly mounted in one of said arms and teeth formed with one of the arm hooks.

In accordance with still further aspects of this invention, pin belts, i.e., belts with outwardly projecting pins are slidably mounted on the printer platen. The pins are positioned to engage the holes that are located along the edges of many types of continuous sheet paper and forms. The belts are horizontally slidable to accommodate different width continuous paper and vertically slidable to compensate for platens sized and driven so as to have a peripheral speed that is slightly greater than an upstream tractor push speed.

As will be readily appreciated from the foregoing summary, the invention provides an adjustable load tear bar mechanism that is ideally suited for use in printers having upstream tractors or other mechanisms designed to push paper or forms to be printed on through the printer. The invention is also useful in printers that are solely friction fed by the platen and feed rollers. Because tear bar and feed roller pressure is controllable, various thickness (e.g., weight) paper as well as various thickness multiple layer forms can be printed and separated in printers utilizing the invention. This result is achieved because the amount of feed roller and tear bar pressure are adjustable to that required by the weight and size of the paper or form to be printed. While not necessary in all environments, the use of platen bands with pin projections is particularly desirable in environments wherein the form or paper to be printed on is multi-layered and the layers are free to slip with respect to one another.

BRIEF DESCRIPTION OF THE DRAWINGS

The foregoing objects and many of the attendant advantages of this invention will become more readily appreciated as the same becomes better understood by reference to the following detailed description when taken in conjunction with the accompanying drawings wherein.

DESCRIPTION OF THE PREFERRED EMBODIMENT

Figure 1:
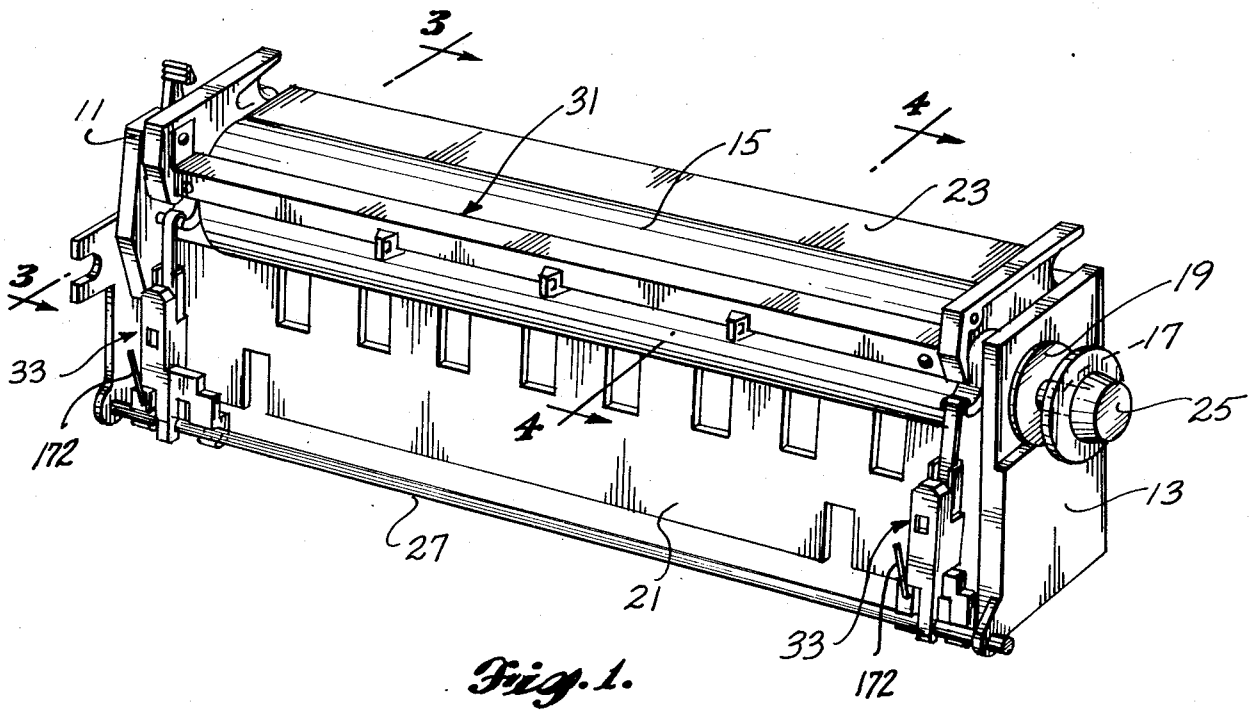
FIG. 1 is a pictorial diagram illustrating an adjustable load, friction feed tear bar mechanism formed in accordance with the invention mounted in a printer.

FIG. 1 is a pictorial view of a preferred embodiment of the invention mounted in a printer. As will be readily appreciated by those familiar with printers, particularly computer controlled printers, the only elements of the printer illustrated in FIG. 1 are those necessary to an understanding of the invention. Elements that are not necessary to an understanding of the invention are not illustrated. The elements of the printer illustrated in FIG. 1 include a pair of vertical walls 11 and 13 that form part of the printer chassis. The walls 11 and 13 lie in parallel planes and support a platen 15 whose shaft 17 is journaled in bearings 19 mounted in the walls 11 and 13. Located beneath the platen 15 is a paper guide 21 that supports and guides paper beneath the platen 15. Extending across the upper rear or exit quadrant of the platen 15 is a paper support plate 23. Mounted on the end of the shaft 17 of the platen 15 is a conventional platen knob 25. Supported by and extending between the walls 11 and 13 in the lower front quadrant of the platen is a rod 27.

Figures 2, 5:
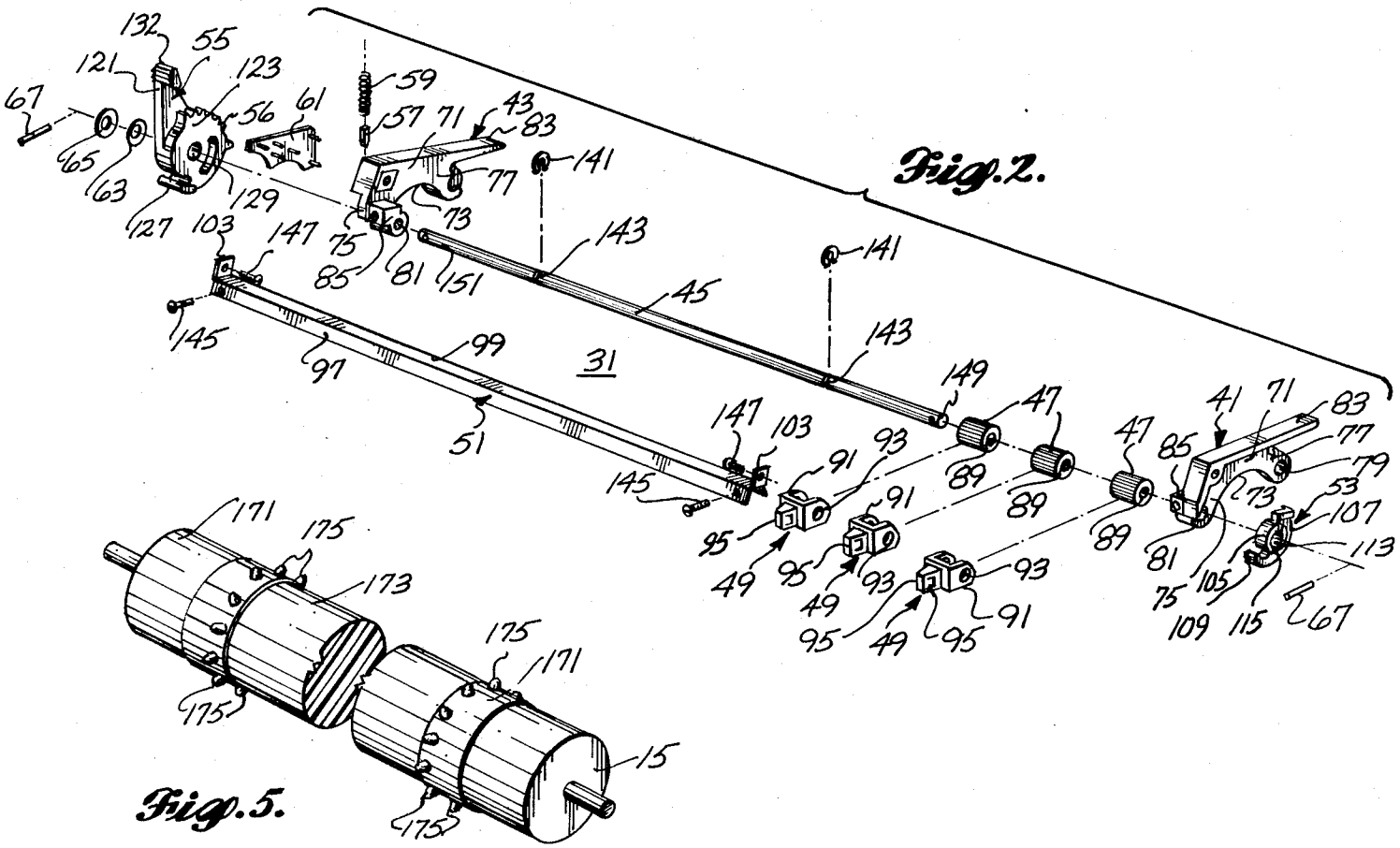
FIG. 2 is an exploded view of the adjustable load, friction feed tear bar mechanism illustrated in FIG. 1.
FIG. 5 is a pictorial view of pin bands formed in accordance with the invention mounted on a printer platen.

As shown in FIG. 1, the adjustable load tear bar mechanism of the invention includes a tear bar assembly 31 and a pair of coil spring assemblies 33. The tear bar assembly 31 is best illustrated in FIG. 2 and comprises: right and left side arms 41 and 43; a roller shaft 45; a plurality of rollers 47; a plurality of roller guides 49; a tear bar 51; an arm hook 53; a detent lever arm hook 55; a detent mechanism comprising teeth 56 on the detent lever arm hook, a plunger 57 and a spring 59; a spring cover 61; a curved washer 63; a flat washer 65; and, a pair of pins 67.

The right and left side arms 41 and 43 are hinge arms that join the other elements of the tear bar assembly 31 to the chassis of the printer. More specifically, the right and left side arms 41 and 43 include a vertical, generally flat body 71 having a circular lower cutout 73, lying in the plane of the body, that creates a front limb 75 and a rear limb 77. The diameter of the lower circular cutout 73 is slightly greater than the diameter of the platen 15. The rear limbs of each of the side arms 41 and 43 include a hinge hole 79 that is used to pin the side arms to related ones of the vertical walls 11 and 13 of the printer chassis. The front limbs 75 of the side arms 41 and 43 include roller shaft holes 81 through which the roller shaft 45 passes. Overlying the body 71 of each of the right and left side arms 41 and 43 is a transverse flange 83. The transverse flange 83 extends rearwardly to a point where it overlies the rear limb 77. The flanges 83 extend outwardly from the side of the bodies 71 facing the wall to which they are pinned. The side of the bodies 71 of the right and left side arms 41 and 43 facing one another each include a protrusion 85 that surrounds the roller shaft holes 81. The protrusions 85 are configured to fit inside of the ends of the tear bar 51, which is formed in the manner described below.

The rollers 47 are cylindrical friction rollers having a serrated periphery formed of a suitable material such as DELRIN available from E.I. Dupont de Nemours & Co., Willmington, Del. 19898. While three rollers are illustrated in the drawings, obviously, a greater or lesser number can be utilized if desired. The holes 89 in the rollers 47 are sized to allow the rollers 47 to slide onto the roller shaft 45.

A roller guide 49 is associated with each of the rollers 47. Each roller guide 49 includes a yoke 91 sized such that a roller 47 can be positioned between the arms of the yoke. The arms of the yoke include holes 93 also sized to allow the roller guides 49 to slide onto the roller shaft 45. The roller guides 49 also include protrusions 95 sized to be grasped by the fingers of an operator and allow the operator to slide the roller guides, and, thus, the rollers positioned between the yokes, back and forth along the roller shaft 45. Thus, the rollers are laterally adjustable to provide uniform drive pressure on paper located between the rollers 47 and the platen 15.

Figure 4:
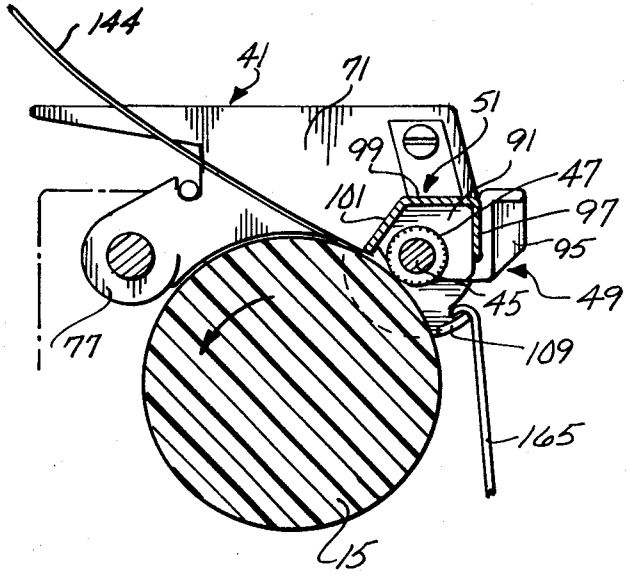
FIG. 4 is a cross-sectional view along line 4—4 of FIG. 1.

The tear bar 51 is a generally U-shaped channel mounted in an inverted position, i.e., the legs 97 and 101 of the channel extend downwardly rather than upwardly. While generally U-shaped, the legs 97 and 101 of the tear bar 51 do not lie parallel to one another. Rather, as illustrated in FIG. 4, when the tear bar 51 is mounted in the manner hereinafter described, the leading leg 97 lies generally orthogonal to the base 99 of the channel. The trailing leg 101 forms an obtuse angle with the base of the channel 99. The angle is such that the trailing leg 101 is arrayed along a diagonal of the platen 15 when the tear bar assembly is correctly mounted in a printer, as illustrated in FIG. 4. As also shown in FIG. 4, the roller guides 49 include a slot between the yokes 91 and the protrusion 95 positioned and formed to receive the leading leg 97 of the tear bar 51. Finally, as illustrated in FIG. 2, located at each end of the tear bar 51 and extending upwardly from the base 99 of the channel is a flange 103.

The arm hook 53 includes a hub 105 having an outwardly extending flange 107. The flange has a hook 109 at one end. The arm hook 53 is sized to fit into the cavity defined by the body 71 and the flange 83 of the right side arm 41 when the hole 113 in the hub 105 is aligned with the hole 81 in the front limb 75 of the right side arm 41. Located in the outer face of the hub 105 is a slot 115. The slot 115 lies along a diagonal of the hub 105.

The detent lever arm hook 55 includes a lever arm 121 that extends outwardly from a body 123 having a generally circular outer periphery. The plurality of teeth 56 that form part of the detent mechansim are located around a portion of the periphery of the body 123. The body 123 also includes a hook 127 whose position is generally diametrically opposed to the position of the teeth 56. Extending outwardly from the circular outer periphery of the body 123, between the teeth 56 and the hook 127, is a stop 128. Located in the center of the body 123, between the teeth 56 and the hook 127, is a hole 129 sized to receive the roller shaft 45. The body 123, including the teeth 56, is sized to be positionable in the cavity defined by the body 71 and the flange 83 of the left side arm 43 when the hole 129 in the body 123 is aligned with the hole 81 in the front limb 75 of the left side arm 43.

Figure 3:
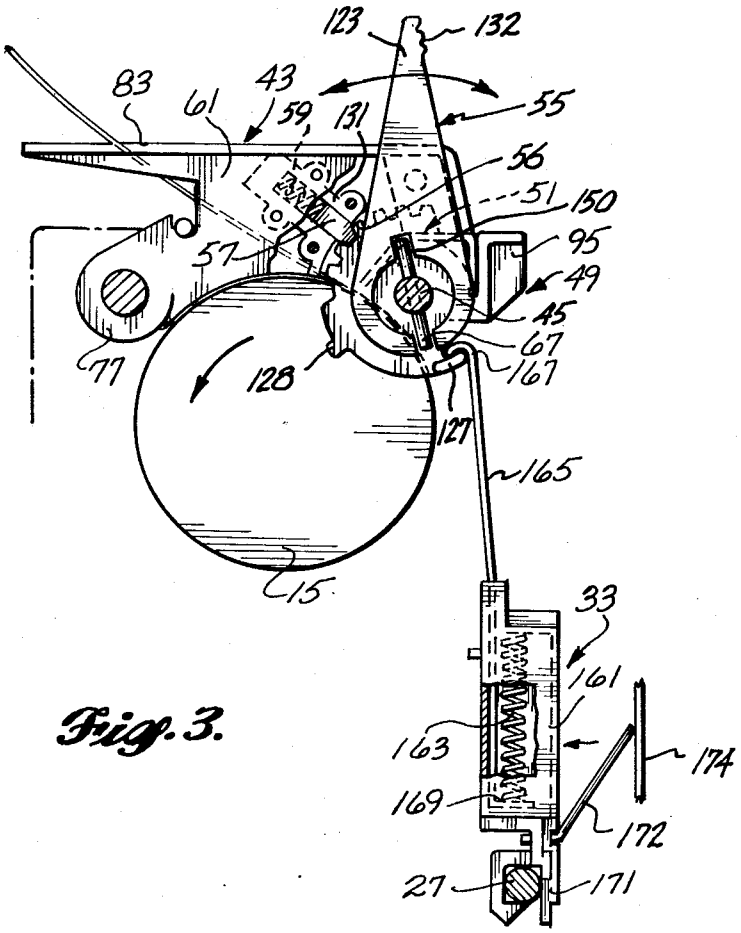
FIG. 3 is a cross-sectional view along line 3—3 of FIG. 1.

Also positioned in the cavity defined by the body 71 and the flange 83 of the left side arm 43 is a housing 131 (FIG. 3). The housing lies along a diagonal of the hole 81 in the front limb 75 that receives the roller shaft 45. The housing 131 is sized and configured to receive the coil spring 59 and the plunger 57. Preferably, the cross-sectional configuration of the cavity in the housing 131 is rectangular as is the cross-sectional configuration of the plunger 57. The plunger 57 includes a pointed tip adapted to impinge on and extend into the space between the teeth 56 formed in the periphery of the body 123 of the detent lever arm hook 55. The spring cover 61 is configured to overlie and enclose the cavity in which housing 131 is located. Formed in the outer face of the lever arm side of the body is a slot 150 that lies along a diagonal of the roller shaft hole 129. The outer end of the lever arm 121 includes a thumb grip 132.

The tear bar assembly 31 illustrated in the figures is created by mounting a roller 47 between the flanges of the yoke 91 of each roller guide 49 and sliding the resultant combination onto the roller shaft 45. C-washers 141 are slid into suitable circular indentations 143 formed in the roller shaft 45. The C-washers 141 are positioned such that at least two rollers 47 always impinge on the rpint receiving medium 144 (e.g., a sheet or sheets of paper or lightweight cardboard) being printed on. The third roller 47, which may or may not impinge on the print receiving medium 144, maintains the roller shaft 45 parallel to the surface of the platen 15. This structure results in the application of uniform pressure to the print receiving medium 144. Uniform pressure prevents the print receiving medium from skewing.

After the rollers 47 and the roller guides are slid onto the roller shaft 45, the right and left side arms 41 and 43 are slid onto the end of the roller shaft 45 and the tear bar 51 is positioned atop the protrusions 85 located on the inner faces of the right and left side arms 41 and 43 such that the leading leg 97 of the tear bar lies in the slots formed between the protrusions 95 and the yokes 91 of the roller guides 49. After being assembled, a first pair of screws 145 are inserted through apertures located in the ends of the front leg 97 of the tear bar 51 and threaded into holes in the front face of the protrusions 85 formed in the inner faces of the right and left side arms 41 and 43. A second pair of screws 147 are inserted through holes in the flanges 103 extending upwardly from the base of the tear bar and threaded into holes in the body 71 of the right and left side arms 41 and 43. Next, the hook arm 53 is slid onto the right end of the roller shaft 45, into the cavity formed by the body 71 and the flange 83 of the right side arm 41. Thereafter, the roller shaft 45 is rotated such that a diametrical hole 149 formed near the adjacent end of the roller shaft 45 is aligned with the slot 115 in the hub 105 of the hook arm 53. Next, one of the pins 67 is slid into the slot 115 in the hub 105 of the hook arm 53 and the hole 149 in the adjacent end of the roller shaft 45.

The detent lever arm 55 is mounted on the other end of the roller shaft 45 such that the ratchet teeth 125 are positioned in front of the housing 131. The plunger 57 and the coil spring 59 are mounted in the housing 131 and the spring cover 61 is attached to the right side arm 43. Thereafter, the curved washer 63 and the flat washer 65 are mounted on the roller shaft 45. Then, the roller shaft is rotated such that a diametrical hole 151 formed in the adjacent end of the roller shaft 45 is aligned with the slot 150 formed in the lever arm side of the body 123. Next, the other pin 67 is slid into the slot 150 in the lever arm side of the body 123 and the hole 151 in the adjacent end of the roller shaft 45.

Because the pins 67 lie in slots formed in the arm hook 53 and the detent lever arm hook 55, rotation of the detent lever arm hook 55 by moving the lever arm 121 rotates the shaft 45. As a result, the position of the hook 109 of the arm hook 53, as well as the position of the hook 127 of the detent lever arm hook 55, is controlled by the position of the detent lever arm hook 55. The detent mechanism, of course, locks the detent lever arm hook in any one of several fixed positions determined by when a cavity between the teeth 56 is aligned with the plunger 57.

The coil spring assemblies 33 each include a box 161 that houses a coil spring 163. An attachment arm 165 lies along the back wall of the box 161. The lower end of the arm 165 includes a transverse projection 169 that extends beneath the lower end of the coil spring 163 and presses the other end of the coil spring against the top of the box 161. As a result, the coil spring 163 applies a downward pressure on the attachment arm 165. The other end of the attachment arm 165 extends upwardly, away from the box and terminates in a hook 167. The hook 167 engages the hook 109 or 127 of the related one of the arm hook 53 or the detent lever arm hook 55. The boxes 161 include clamp extensions 170 adapted to impinge and grip the rod 27 that extends between the walls 11 and 13 of the printer chassis illustrated in FIG. 1 and previously described.

Extending outwardly from each box 161 of the coil spring assemblies 33 is a spring arm 172. The outer ends of the spring arms impinge on a wall 174 forming part of the printer chassis, or an abutment (not shown) attached to the printer chassis. The spring arms 172 create a force that rotates their related boxes 161 and attachment arms 165 toward the platen 15.

As can be readily seen from the drawings, when the lever arm 121 of the detent lever arm hook 55 is rotated in a counterclockwise direction, as viewed in FIG. 3, the attachment arms 165 are pulled upwardly. As a result, the coil springs 163 housed in the boxes 161 apply a greater pressure to the arm hook 53 and the detent lever arm hook 55. This additional pressure is applied through the right and left side arms 41 and 43 and the roller shaft 45 to the rollers 47 and the tear bar 51. As a result, the position of the detent lever arm hook 55 controls the pressure applied by the rollers and the tear bar to print receiving medium 144 lying between these elements and the platen 15. The print head (not shown) moves across the paper slightly upstream of the tear bar. The print head may be a serial dot matrix printer print head, for example.

When the lever arm 121 is rotated in a clockwise direction (as viewed in FIG. 3) to its most extreme position the stop 128 impinges on the bottom of the left side arm 43. In this position the arm hook 53 and the detent lever arm hook 55 become disengaged from the hooks on the ends of the attachment arms 165. Disengagement occurs because the following movement of the attachment arms 165 caused by the spring arms 172 ends when the boxes 161 impinge on the printer paper guide 21 (FIG. 1). As a result, the tear bar assembly is released. When released the tear bar assembly can be rotated out of the way allowing the print receiving medium 144 to be loaded into the printer.

The most extreme position of the lever arm in the counterclockwise direction is reached when the thumb grip 132 impinges on the top of the left side arm 43. When the lever arm is in this position, maximum pressure is applied to the tear bar assembly 31 by the coil spring assemblies 33.

As previously discussed, the invention is ideally suited for use in printers designed to print on continuous blank sheets of paper or continuous forms either delivered to the printer platen by upstream tractors (not shown) or pulled through the printer solely by friction between the platen 15 and the rollers 47. The disadvantage of relying solely on platen friction feed is the probability that the continuous sheets or forms will become skewed after a period of time, resulting in printer down time for the needed realignment. Thus, upstream tractors are highly desirable if not necessary in many environments. As also noted above, upstream tractors are most successful when the peripheral speed of the platen is slightly greater than the push speed of the tractors. This speed differential eliminates bulges between the tractors and the platen and is readily accomplished by making the platen slightly oversized for the driving speed. The main disadvantage of the speed differential is the requirement that the medium to be printed on, e.g., the paper, slip on the platen. While it is relatively easy to make a single sheet slip satisfactorily, problems can occur when the print receiving medium is multi-layered. Problems occur because the layers may slip with respect to one another and create a bulge, particularly if the layers are not attached by some means, such as an adhesive located along the region of a perforated tear strip located along the edge of the continuous paper, sheets or forms. As illustrated in FIG. 5, the invention also provides a mechanism for avoiding this problem. More specifically, FIG. 5 illustrates a pair of bands 171 mounted on a platen 173. The inner diameter of the bands 171 is such that the bands 171 can "slip" on the platen 173. Mounted on the bands 171 are a plurality of outwardly projecting pins 175. The pins are located in a circumferential ring and sized and spaced similar to the pins of the conventional printer tractor. Thus, the pins are sized to receive the perforations in the edge tear strips of continuous sheets of paper and forms. Since the bands 171 can slip on the platen 173, they provide compensation for platens designed to have a peripheral speed that is greater than the push speed of upstream tractors. Slippage between multiple layer sheets is avoided by the pins, which maintain sheet alignment. Each band 171 is aligned with one of the rollers 47 mounted on the roller shaft 45 of the tear bar assembly 31. It is the force normal to the surface of the platen 15 created by the rollers 47 that creates a tangential friction drive force between the platen 15 and the print receiving medium.

Friction feed tear bar mechanisms formed in accordance with the invention have been found to function in an excellent manner when the print receiving medium is a multi-layer paper, the layers of which are selectively welded (e.g., cemented) together along the edges of the paper or to other sections to create a particular separation of sheets required by a user (e.g., 1 sheet +3 sheets +2 sheets).

While a preferred embodiment of the invention has been illustrated and described, it will be appreciated that various changes can be made therein without departing from the spirit and scope of the invention. Hence, the invention can be practiced otherwise than as specifically described herein.

The embodiments of the invention in which an exclusive property or privilege is claimed are defined as follows:

1. An adjustable load, quick tear bar mechanism for a printer having a cylindrical platen that friction feeds a print receiving medium through the printer and provides support for the print receiving medium as said medium is printed on by the actuation of a print head, said adjustable load, quick tear bar mechanism comprising:

(a) arm means for supporting a tear bar, said arm means comprising at least two arms positioned at opposite ends of said platen so as to overlie said platen, each of said arms including an upstream end and a downstream end, the downstream ends of said arms being pivotally attached to said printer;

(b) a tear bar mounted on the upstream ends of said arms for pressing said print receiving medium against said platen;

(c) a plurality of rollers and a roller shaft, said rollers being mounted on said roller shaft and said roller shaft being mounted between the upstream ends of said arms; and, (d) controllable pressure means for applying pressure to the upstream ends of said arms and said tear bar to control the pressing force applied by said tear bar to said print receiving medium such that said tear bar continues to press said print receiving medium against said platen when a manual force adequate to separate said print receiving medium at said tear bar is applied to said print receiving medium downstream of said tear bar, said controllable pressure means including:

(1) coil spring means having one end attached to said printer and the other end attached to the ends of said roller shaft; and, (2) hook means mounted on said roller shaft so as to rotate with said roller shaft, said hook means including hooks connectable to said coil spring means such that said coil spring means apply pressure to said roller shaft and, thus, said rollers, via said hook means.

2. An adjustable load, quick tear bar mechanism as claimed in claim 1, wherein said tear bar is an elongate channel having a generally U-shaped cross-sectional configuration, said elongate generally U-shaped channel being mounted on said upstream ends of said arms such that the legs of said channel extend generally downwardly.

3. An adjustable load, quick tear bar mechansim as claimed in claim 2, wherein said rollers and said roller shaft are positioned between the downwardly extending legs of said elongate generally U-shaped channel.

4. An adjustable load, quick tear bar mechanism as claimed in claim 3, wherein an edge of one of said legs of said elongate generally U-shaped channel is situated close to said print head and lies along a diagonal of said platen.

5. An adjustable load, quick tear bar mechanism as claimed in claim 4, including detent means for controlling the position of said hook means and, thus, the pressure applied to said roller shaft and, thus, said rollers by said coil spring means.

6. An adjustable load, quick tear bar mechanism as claimed in claim 1, including detent means for controlling the position of said hook means and, thus, the pressure applied to said roller shaft and, thus, said rollers by said coil spring means.

7. An adjustable load, quick tear bar mechanism as claimed in claim 1 including at least one band slidably mounted on the cylindrical platen of said printer, said at least one band including a plurality of outwardly projecting pins located in a circumferential ring and spaced apart by an amount suitable for the pins to receive the edge perforations of continuous sheets of a print receiving medium.

8. An adjustable load, quick tear bar mechanism as claimed in claim 6 including at least one band slidably mounted on the cylindrical platen of said printer, said at least one band including a plurality of outwardly projecting pins located in a circumferential ring and spaced apart by an amount suitable for the pins to receive the edge perforations of continuous sheets of a print receiving medium.

* * * * *